US008193691B2

(12) United States Patent
Durand et al.

(10) Patent No.: US 8,193,691 B2
(45) Date of Patent: Jun. 5, 2012

(54) ELECTRON TUBE WITH OPTIMIZED INJECTION OF THE ELECTRON BEAM INTO THE TUBE

(75) Inventors: Alain Joseph Durand, La Garenne (FR); Rodolphe Marchesin, Gif sur Yvette (FR)

(73) Assignee: Thales (FR)

( * ) Notice: Subject to any disclaimer, the term of this patent is extended or adjusted under 35 U.S.C. 154(b) by 0 days.

(21) Appl. No.: 12/955,846

(22) Filed: Nov. 29, 2010

(65) Prior Publication Data

US 2011/0291545 A1 Dec. 1, 2011

(30) Foreign Application Priority Data

Nov. 27, 2009 (FR) ..... 09 05722

(51) Int. Cl.
*H01J 29/46* (2006.01)

(52) U.S. Cl. ..... 313/442; 313/446; 315/5.35

(58) Field of Classification Search ..... 313/364–482
See application file for complete search history.

(56) References Cited

U.S. PATENT DOCUMENTS 2,800,603 A 7/1957 Bryant et al.

FOREIGN PATENT DOCUMENTS

| | | | |
|---|---|---|---|
| FR | 2 925 758 | A1 | 6/2009 |
| FR | 2 925 759 | A1 | 6/2009 |
| WO | 2009/083214 | A1 | 7/2009 |
| WO | 2009/083540 | A1 | 7/2009 |

*Primary Examiner* — Mariceli Santiago
*Assistant Examiner* — Donald Raleigh
(74) *Attorney, Agent, or Firm* — Baker & Hostetler, LLP

(57) ABSTRACT

An electron tube includes a microwave structure, an electron gun having a cathode-wehnelt assembly, with axis for providing a linear electron beam along the same axis in a circular cylindrical passage with axis of the microwave structure, the cathode comprising a centre of rotation of the beam on the said axis of the cathode. The electron gun and the microwave structure each comprise portions of spherical surfaces in contact inscribed on one and the same sphere of radius centred on the centre of the cathode so as to form a swivel for angular adjustment of the axis of the cathode and to make the axis of the electron beam coincide with the axis of the circular cylindrical passage of the microwave structure. Applications include microwave electron tubes such as travelling wave tubes and klystrons.

9 Claims, 5 Drawing Sheets

ELECTRON TUBE WITH OPTIMIZED INJECTION OF THE ELECTRON BEAM INTO THE TUBE

CROSS-REFERENCE TO RELATED APPLICATION

This application claims priority to foreign French patent application No. FR 0905722, filed on Nov. 27, 2009, the disclosure of which is incorporated by reference in its entirety.

FIELD OF THE INVENTION

The invention relates to linear-beam microwave tubes such as travelling wave tubes TWT, klystrons and notably to a device for adjusting the position of the gun in the tube.

BACKGROUND

Linear-beam microwave tubes essentially comprise an electron gun having a cathode providing a cylindrical beam of electrons in an evacuated cylindrical envelope of a microwave structure of the tube. A collector, at one end of the microwave structure, gathers the electrons of the beam exiting the cylindrical envelope.

The electrons exiting the cathode are focused in the form of a linear beam in the evacuated cylindrical envelope by means of a magnetic field. This magnetic field may be created either by permanent magnets, or by windings around the evacuated cylindrical envelope.

FIG. 1 represents a prior art klystron comprising an electron gun 10, a microwave structure 20 comprising resonant cavities C1, C2, C3, C4 and drift tubes in the case of a klystron and, an electron collector 24.

The microwave structure 20 is the element of the tube comprising the evacuated cylindrical envelope with axis Zs, Zs' where an interaction is performed between a linear electron beam 26 and an electromagnetic wave which may be, either applied to a radiofrequency input Pe 28 of the tube in the case of amplifier tubes, or created in the tube in the case of tubes operating as microwave oscillators. More precisely the electron beam 26 gives up part of its kinetic energy to the electromagnetic wave in the microwave structure. The tube comprises a microwave power output Ps 30.

The electron gun of the tube is often a gun of Pierce type. FIG. 2 shows a simplified cross-sectional view of an electron gun for electron tube of the prior art.

The electron gun of FIG. 2 comprises a spherical-dish-shaped cathode 50 with axis of revolution Zc,Zc' providing the electrons of a linear beam 52, an electrode 54 serving for the shaping of the beam (also designated by the term wehnelt). The electron beam emitted by the cathode-wehnelt assembly is in general convergent, that is to say that its diameter decreases on moving away from the cathode.

An anode 56 of the tube in front of the cathode-wehnelt assembly accelerates the electrons of the beam exiting the gun along the said axis Zc,Zc'.

The electron gun possesses a symmetry of revolution about the axis Zc,Zc' which is also the axis of the cathode 50.

The cathode 50 comprises a point O on the axis Zc,Zc', designated also by centre of the cathode, such that when the cathode rotates about the said centre O by an angle θ with respect to the axis Zc,Zc' this point O remains on the axis Zc,Zc'.

The beam 52 also possesses a symmetry of revolution about the axis of revolution Zc,Zc' of the cathode.

When the electron beam has finished converging it attains its minimum diameter, and then diverges under the effect of the electrostatic forces due to the space charge. To keep the beam at the desired diameter it is necessary to use a magnetic field generated by an electromagnet or by permanent magnets situated around the evacuated cylindrical envelope. This magnetic field possesses a symmetry of revolution about the axis Zs,Zs' of the microwave structure.

The magnetic fields around the beam, along the evacuated envelope, are created by devices called focusers.

FIGS. 3*a* and 3*b* show two types of focusers of the electron beam in a microwave tube.

FIG. 3*a* shows a focuser of a tube comprising a solenoid 60 energized by an electric current producing a magnetic focusing field parallel to the axis Zs,Zs' of the microwave structure of the tube. An electron gun 62 provides a linear beam 64 in an evacuated circular cylindrical passage 66 of the structure.

FIG. 3*b* shows another type of focuser comprising a set 70 of n permanent magnets p1, . . . pi, . . . pn of toric shape, coaxial with the axis Zs,Zs' of the structure creating an alternating magnetic field along the said axis Zs,Zs'.

The circular cylindrical passage 66 of axis Zs,Zs' for the electron beam in the microwave structures of the tubes, and whose diameter is close to the diameter of the beam, is also the zone of interaction between the microwave structure and the beam.

In theory, the axis Zc,Zc' of the electron beam emitted by the cathode tied to the gun and the interaction zone axis Zs,Zs' tied to the microwave structure must coincide. In practice, when the gun is joined to the microwave structure to form the electron tube, the positioning of the gun (and consequently of the cathode) and of the microwave structure is not the desired one, giving rise to a defect of positioning of the gun.

This defect of positioning of the gun can be expressed by means of 5 parameters that can, for simplification, be reduced to three:

- 3 parameters giving the coordinates of the actual position of the centre of the cathode Or with respect to the theoretical position Ot in a reference frame tied to the axis Zs,Zs'
- 2 angular parameters giving the inclination of the axis Zc,Zc' with respect to the axis Zs,Zs'.

Concerning the defect of positioning of the point Or, it is possible to go from 3 parameters to 2 by considering the plane XY perpendicular to Zs,Zs' and passing through the point Or. The distance between the point Ot and the point of intersection $O_1$ of the plane XY with the axis Zs,Zs' corresponds to a distance defect that can be corrected by a translation parallel to the axis Zs,Zs'. In the plane XY the distance Or $O_1$ between the point Or and the axis Zs,Zs' corresponds to a concentricity defect which involves the 2 coordinates of Or in the plane XY. It is possible without loss of generality to make the axis X pass through the point Or (FIG. 4).

In a system of cylindrical coordinates about an axis Z" parallel to Zs,Zs' passing through the point Or, the direction of the axis Zc,Zc' may be described by 2 angles:

- An angle ϕ giving the bearing in the plane XY
- An angle θ giving the elevation (between the axes OrZ" and OrZc'). It is this angle θ which characterizes the defect of parallelism between the axes Zs,Zs' and Zc,Zc'.

When the concentricity defect is zero (Or on the axis Zs,Zs') the parallelism defect of the gun does not depend on the angle ϕ when the gun and the line have symmetry of revolution. When the parallelism defect is zero (θ=0) and the concentricity defect is nonzero, the gun positioning defect also does not depend on the angle ϕ when the gun and the evacuated cylindrical envelope of axis Zs,Zs' have symmetry of revolution. On the other hand, for nonzero concentricity and parallelism defects, the gun positioning defect depends on the bearing $\phi$: indeed, it is not the same thing to inject a beam in the direction of the axis Zs,Zs' and at 180° to this direction. The objective being to obtain $\theta=0$, it is indeed this angle that will be taken in order to characterize the parallelism defect of the gun. In conclusion, the gun positioning defect will be characterized by the following 3 quantities:

Distance defect $OtO_1$

Concentricity defect $O_1Or$

Parallelism defect.

The tubes of the prior art comprise devices for adjusting the position of the gun with respect to the structure so that the centre O of the cathode and the theoretical point Ot on the one hand and the axes Zs,Zs' and Zc,Zc' on the other hand are made to coincide.

FIG. 5 shows a partial view of a tube of the prior art comprising a gun equipped with a device for adjusting its position in the tube.

More precisely, FIG. 5 shows a sectional view, in an axial plane P, of an electron gun 80 mounted on the acceleration anode 82 of an electron tube. The acceleration anode 82 is secured to the microwave structure of the tube, on the axis Zs,Zs', and comprises a hole 83 in the said axis Zs,Zs' for the passage of the electron beam into the microwave structure of the tube.

The circular cylindrical shaped gun 80 comprises a circular envelope 84 of ceramic material with axis Zc,Zc' having the cathode-wehnelt assembly 86 held on the axis Zc,Zc' of the gun by a conically shaped skirt 90 secured, by one 92 of its two edges, to the circular envelope of the gun and, by its other edge 94, to the cathode-wehnelt assembly 86.

The gun of FIG. 5 is surrounded by an adjusting collar 100 coaxial with the axis of the gun ZcZc' secured to the circular envelope 84 of the gun and comprising tapped holes 102 with adjusting screws 104 for adjusting the position of the cathode-wehnelt assembly 86. For this purpose the adjusting screws 104 are in contact with the surface of another collar 106, coaxial with the axis of the microwave structure Zs,Zs', secured to the acceleration anode 82 of the tube.

A deformable bellows 108 surrounding the gun 80 ensures the leaktightness of the gun and of the evacuated microwave structure.

The mounting of the gun onto the anode 82 secured to the microwave structure of the tube customarily exhibits a distance defect that one tries to minimize by translating the gun, and therefore the centre O of the cathode, by an action on the adjusting screws 104 so as to bring it closer to the theoretical centre Ot on the axis Zs,Zs' of the microwave structure (see FIG. 4).

By translating with the adjusting screws 104 the gun 80 so that the points P1 and Ot correspond to the same abscissa on the axis Zs,Zs', there remains a radial gap between the points O1 and Ot giving rise to the concentricity defect. By adjusting the screws 104 differently, it is possible to make the gun tilt and thus to correct the parallelism defect; on the other hand this arrangement does not make it possible to correct the concentricity defects which require a displacement transverse to the axis Zs,Zs'.

In the linear-beam tubes of the prior art, the defects of concentricity and of parallelism of the axes of the beam and of the interaction zone of the microwave structure result from the fitting and mechanical overhaul operations performed on the gun and tube body sub-assemblies. A few guns are furnished with systems for position adjustment by deformation like those of FIG. 5 with a deformable bellows to maintain vacuum-tightness, but, in general, the tilting of the cathode-wehnelt assembly does not make it possible to correct both the concentricity defect and the parallelism defect, the correction of a concentricity defect possibly producing a parallelism defect, and vice versa.

SUMMARY OF THE INVENTION

To alleviate the defects of injection of the electron beam into the microwave structure of an electron tube, the invention provides an electron tube comprising a microwave structure, an electron gun having a cathode-wehnelt assembly, with axis Zc,Zc' for providing a linear electron beam along the same axis Zc,Zc' in a circular cylindrical passage with axis Zs, Zs' of the microwave structure, the cathode comprising a centre O of rotation of the beam on the said axis Zc,Zc' of the cathode, wherein the electron gun and the microwave structure each comprise portions of spherical surfaces in contact inscribed on one and the same sphere of radius R centred on the centre O of the cathode so as to form a swivel for angular adjustment of the axis Zc,Z' of the cathode and to make the axis Zc,Zc' of the electron beam coincide with the axis Zs,Zs' of the said circular cylindrical passage of the microwave structure.

Advantageously, the gun comprises a ceramic circular envelope with axis of revolution Zc,Zc' having two ends, one of the ends being on the microwave structure side and, inside the circular envelope, on the axis Zc,Zc', the cathode-wehnelt assembly of the gun.

In one embodiment of the tube, the end of the circular envelope in proximity to the microwave structure is prolonged by a tubular wall, coaxial with the axis of the circular envelope of the gun and secured to the said end of the circular envelope, the tubular wall comprising, on the side of its free end, a setup ring having an external circular surface inscribed within the sphere of radius R centred on the centre O of the cathode, the microwave structure having, on the side of the setup ring, an anode wall, in a plane T perpendicular to the axis Zs,Zs', secured to the microwave structure, the anode wall comprising a circular recess with axis Zs,Zs' of partially spherical shape inscribed within the same sphere of radius R centred on the centre O of the cathode so as to form with the setup ring of the gun the swivel for adjusting the angular position O of the gun, a hole in the anode wall, with axis Zs,Zs', for the passage of the electron beam into the microwave structure.

In another embodiment, the gun comprises, furthermore, a device for adjusting its angular position $\theta$ having, on the side of the setup ring, an adjusting collar surrounding the circular envelope of the gun and secured mechanically to the said circular envelope in a plane T' perpendicular to the axis Zc,Zc' of the gun by way of a ring-shaped bush surrounding the gun, the adjusting collar comprising threaded holes for at least three adjusting screws for adjusting the angular position of the gun, with axes parallel to the axis of the gun, and distributed regularly over the adjusting collar around the gun, the ends of the adjusting screws being in contact with the anode wall so as to exert forces on the said anode wall and to rotate the gun about the centre O of the cathode so as to establish the alignment of the axis Zc,Zc' of the gun with the axis Zs,Zs' of the circular cylindrical passage in the microwave structure.

In another embodiment, the anode wall is secured to the gun by a deformable circular bellows surrounding the gun, one of the circular ends of the bellows being secured to the adjusting collar surrounding the gun, the other circular end of the said bellows being secured to the anode wall of the microwave structure.

In a variant embodiment of the tube according to the invention, the gun comprises a circular envelope of ceramic material having on its axis Zc,Zc' the cathode-wehnelt assembly, an edge of the circular envelope of the gun, on the side of an anode wall of the microwave structure, comprises a ring-shaped swivel collar having an upper part and a lower part, the lower part of the swivel collar comprises a partially spherical concave circular surface inscribed within the sphere of radius R centred on the centre O of the cathode, the anode wall being prolonged towards the gun in the form of an anode ring of thickness Ec close to the thickness of the circular envelope of the gun, with axis Zs,Zs' and with external surface inscribed within the same circle of radius R centred on the centre O of the cathode so as to form with the partially spherical concave circular surface of the swivel collar a swivel for angular adjustment of the gun.

BRIEF DESCRIPTION OF DRAWINGS

Other characteristics and advantages of the invention will become apparent with the aid of the description which follows offered in relation to appended drawings in which.

DETAILED DESCRIPTION

Figure 1:
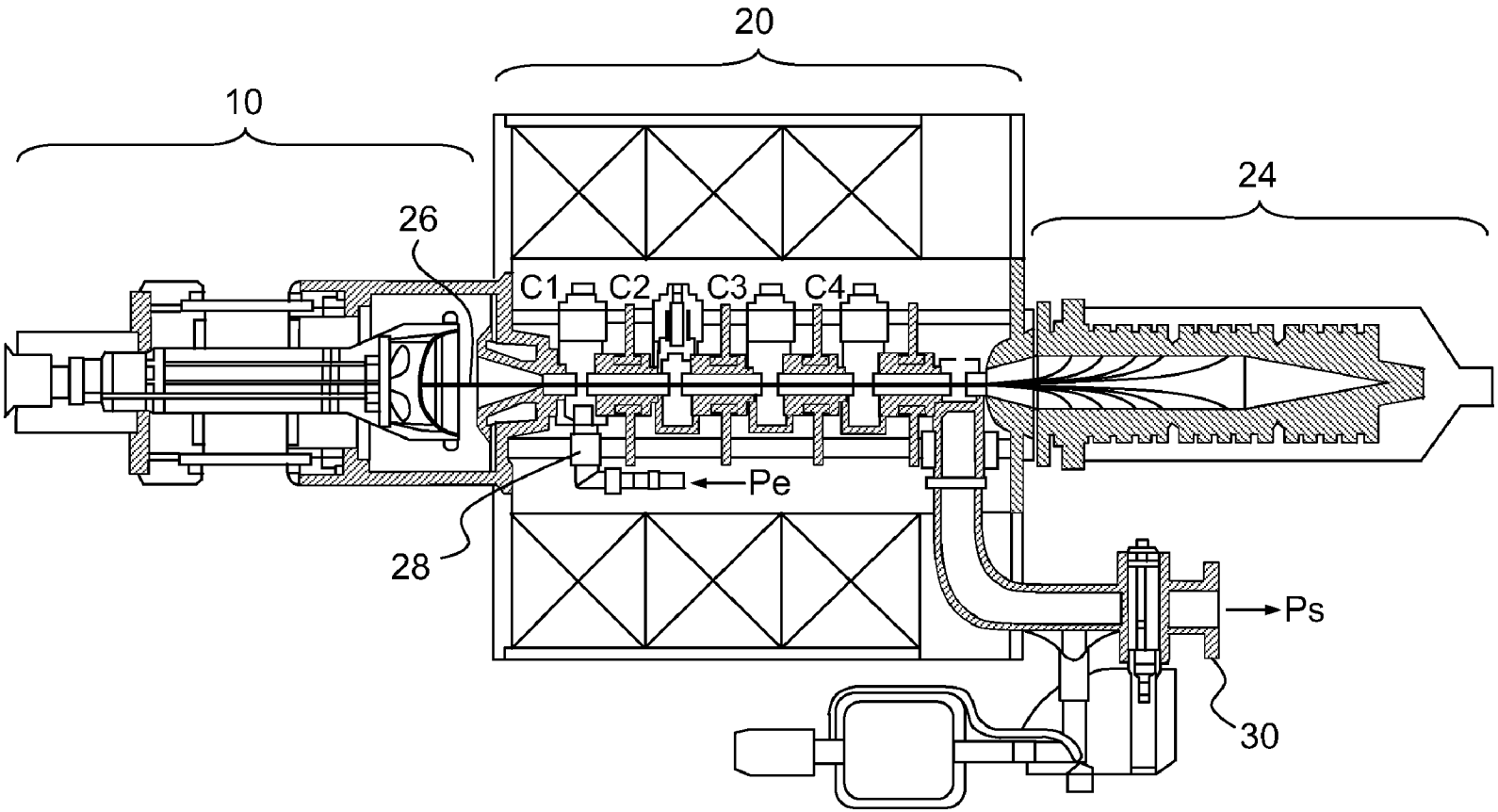
FIG. 1, already described, represents a klystron of the prior art.
Figure 2:
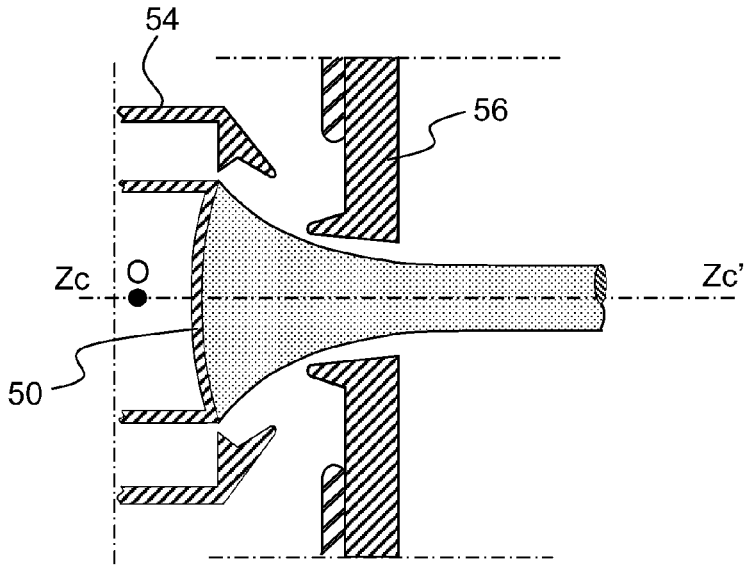
FIG. 2, already described, shows a simplified cross-sectional view of an electron gun for electron tube of the prior art.
Figure 3A:
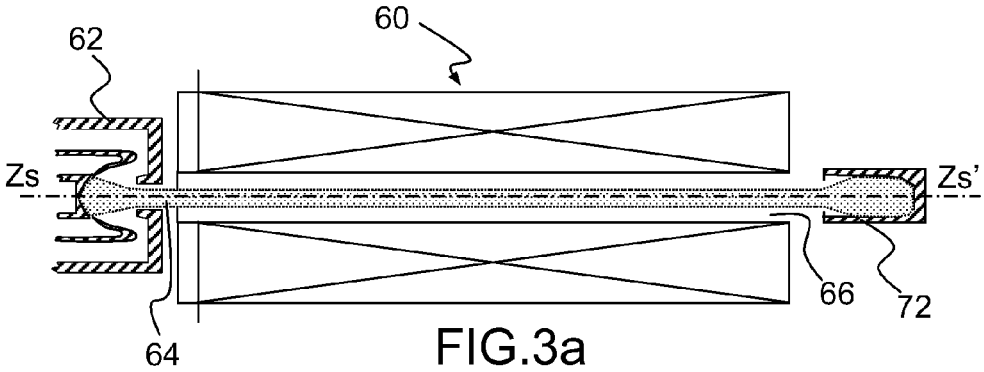
FIGS. 3*a* and 3*b* show two types of focusers of the electron beam in a microwave tube.
Figure 3B:
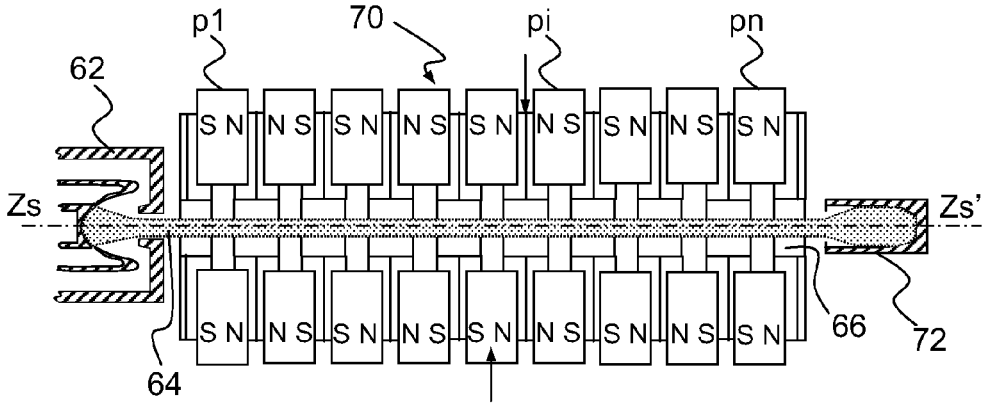
Figure 4:
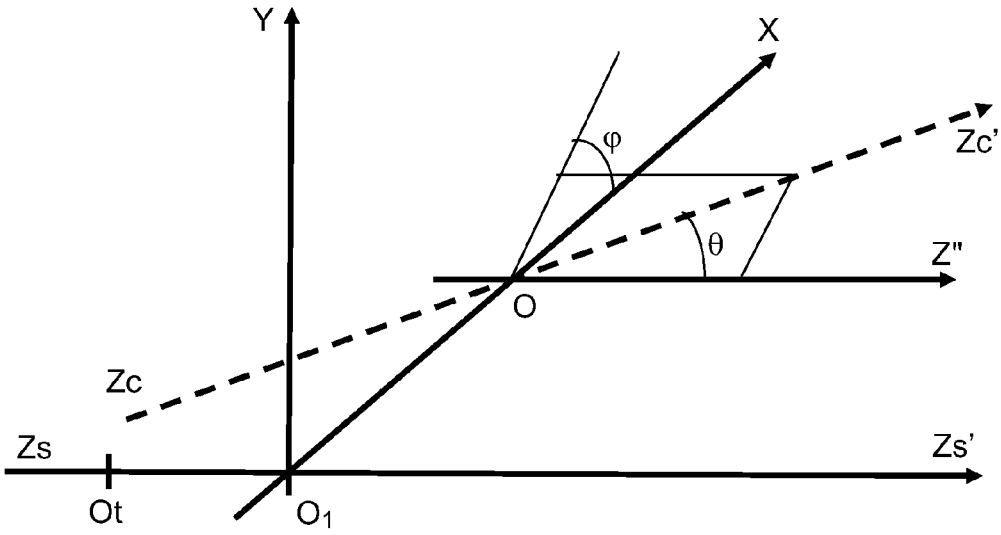
FIG. 4 represents the gaps between the position of mounting of the gun of an electron tube and the desired position.
Figure 5:
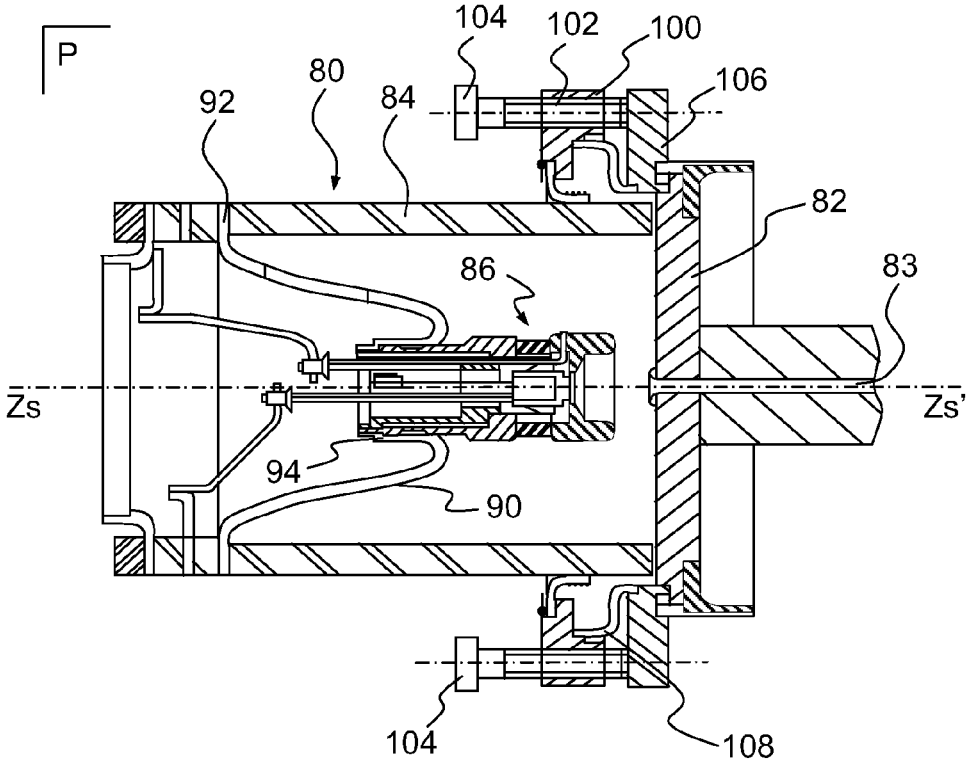
FIG. 5 shows a partial view of a tube of the prior art comprising a gun equipped with an adjusting device for adjusting its position in the tube.
Figures 6A, 6B:
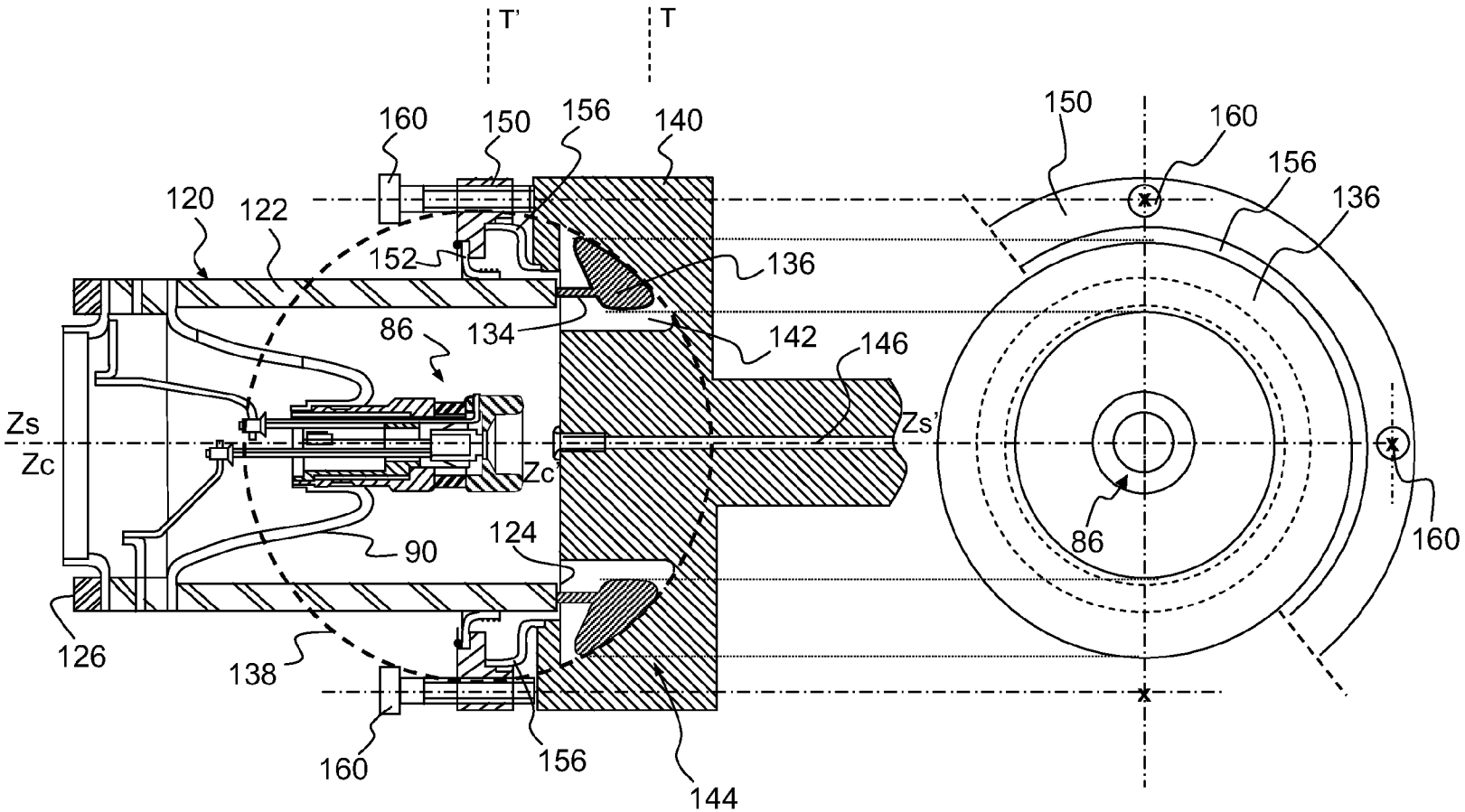
FIGS. 6*a* and 6*b* show a first embodiment of an electron tube comprising an adjusting device for adjusting, according to the invention, the position of the electron gun of the tube.

FIGS. 6*a* and 6*b* show a first embodiment of an electron tube comprising an adjusting device for adjusting, according to the invention, the position of the electron gun of the tube.

More precisely, FIG. 6*a* shows an axial sectional partial view of an electron tube showing an electron gun 120 of the electron tube comprising the adjusting device according to the invention, FIG. 6*b* a partial end-on view of the gun of FIG. 6*a*.

The gun of FIGS. 6*a* and 6*b* comprises a ceramic circular envelope 122 with axis of revolution Zc,Zc' having two ends 124, 126, one of the ends 124 being on the microwave structure side of the tube and, inside the circular envelope, on the axis Zc,Zc', a cathode-wehnelt assembly 86.

The cathode-wehnelt assembly 86 is secured to the circular envelope 122 of the gun by a skirt 90 of conical shape ensuring the centring of the axis of the cathode-wehnelt assembly collinear with the axis Zc,Zc' of the gun. The axis of the cathode-wehnelt assembly 86 coincides with the axis of the cathode and with that of the electron beam emitted by the cathode.

The end 124 of the circular envelope 122 of the gun 120, in proximity to the microwave structure of the tube, is prolonged by a tubular wall 134, coaxial with the axis of the circular envelope 122 of the gun and secured to the said end 124. The tubular wall 134 comprises, on the side of its free end, a setup ring 136 having an external circular surface inscribed within a sphere 138 of radius R centred on the centre O of the cathode of the gun 120.

The microwave structure of the tube comprises, on the side of the setup ring 136 of the gun, an anode wall 140, in a plane T perpendicular to the axis Zs,Zs' of the tube. The anode wall 140 comprises a circular recess 142 with axis Zs,Zs' of partially spherical shape inscribed within the same sphere 138 of radius R centred on the centre of rotation O of the cathode so as to form, with the said setup ring 136, a swivel 144 for adjusting the angular position θ of the gun.

A hole 146 in the anode wall 140, with axis Zs,Zs,' ensures the passage of the electron beam emitted by the gun 120 into the microwave structure. The hole is thus aligned with the circular cylindrical passage of the said microwave structure of the tube.

The gun 120 comprises, furthermore, an adjusting device for adjusting its angular position θ. This angular adjusting device comprises, on the side of the setup ring 136, an adjusting collar 150 surrounding the gun and secured mechanically to the circular envelope of the gun in a plane T' perpendicular to the axis Zc,Zc' of the gun by way of a ring-shaped bush 152 surrounding the gun.

The bush 152 is for example brazed by one of its edges onto the adjusting collar 150 and by its other edge onto the external surface of the circular envelope 122 of the gun.

The anode wall 140 of the tube is secured to the gun 120 by a ring-shaped deformable circular bellows 156 surrounding the gun, one of the circular ends of the bellows 156 being secured to the adjusting collar 150 surrounding the gun, the other circular end of the said bellows being secured to the anode wall 140 of the tube.

The bellows ensures the vacuum-tightness of the gun 120 and of the microwave structure of the tube and must therefore be sufficiently rigid to support the external atmospheric pressure but also be deformable so as to ensure the angular adjustment θ of the gun with respect to the axis Zs,Zs' of the circular cylindrical passage of the microwave structure of the tube.

The bellows may be made of a material such as a nickel alloy, stainless steel, or any other material sufficiently resistant to the loads from the atmospheric pressure but also deformable.

In this embodiment, the adjusting collar 150 comprises threaded holes for four of the adjusting screws 160, with axes parallel to the axis of the gun, and distributed regularly over the adjusting collar around the gun in angular steps of 90 degrees.

The ends of the adjusting screws are in contact with the anode wall 140 of the tube so as to exert forces on the said anode wall, when adjusting the position of the gun, by rotating the gun about the centre O of the cathode and thus establish the alignment of the axis Zc,Zc' of the gun with the axis Zs,Zs' of the circular cylindrical passage of the microwave structure of the tube.

On account of the vacuum in the tube and in the gun, the gun 120 is held strongly applied to the anode wall 140 of the tube by the atmospheric pressure, the contact between the two spherical surfaces of the swivel 144 of the adjusting device is thus constantly ensured and consequently the defect of concentricity of the gun with respect to the evacuated cylindrical envelope is zero.

Adjusting the position of the screws 160 in the adjusting collar 150 produces exclusively a rotation of the axis Zc,Zc' of the gun about the centre O of the cathode.

Adjusting the gun consists, as has been previously described, in rendering the axis Zc,Zc' of the beam (or of the cathode) collinear with the axis Zs,Zs' of the passage in the microwave structure of the electron tube.

The action of screwing and/or unscrewing one or more adjusting screws 160 produces the desired rotation of the gun about the centre O of the cathode in a solid angle of the sphere 138 of radius R.

The setup ring 136 of the swivel 144 can be produced by machining a material chosen from among materials such as ceramics, metals.

Figures 7A, 7B:
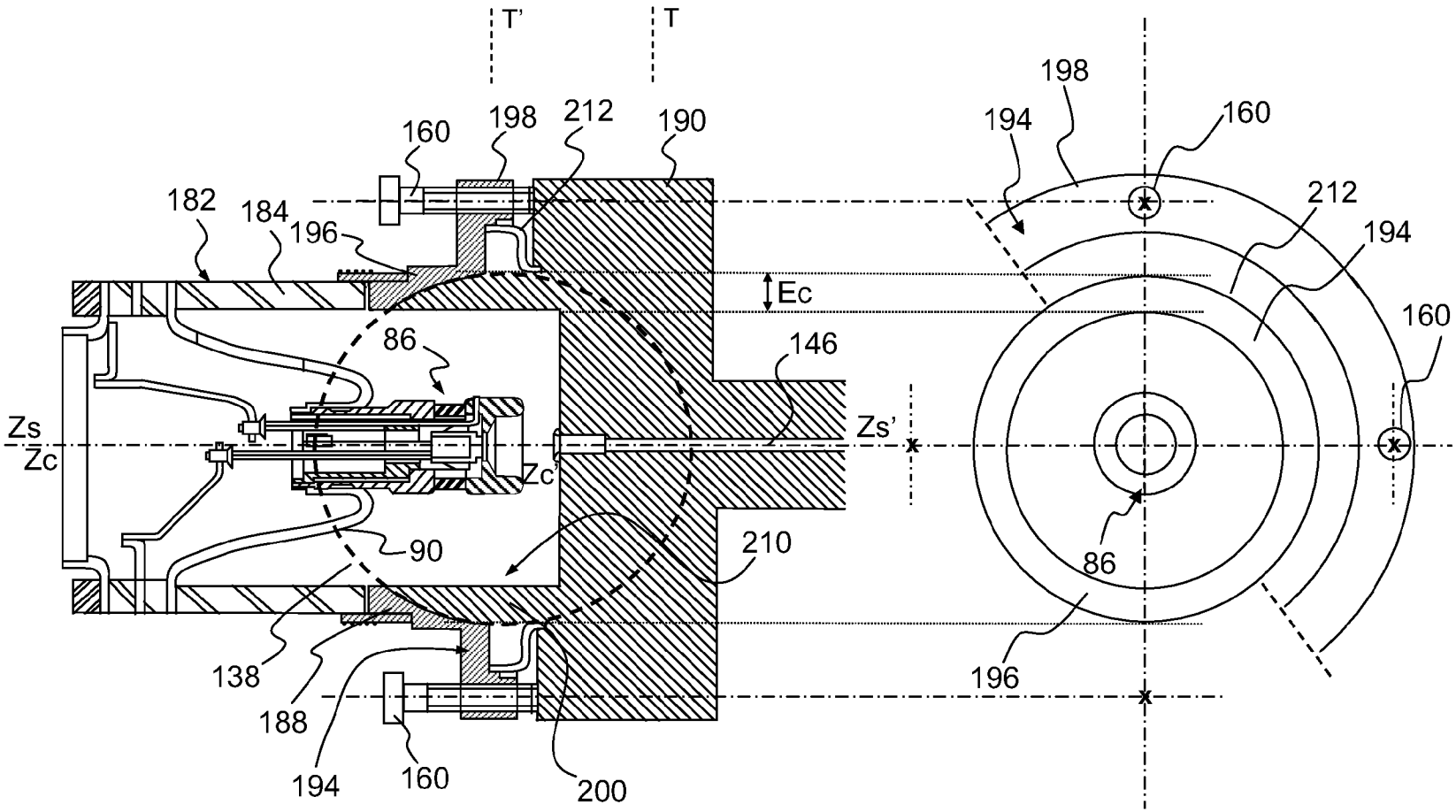
FIGS. 7*a* and 7*b* show a variant embodiment of the electron tube of FIGS. 6*a* and 6*b* comprising an adjusting device for adjusting, according to the invention, the position of the electron gun of the tube.

FIGS. 7*a* and 7*b* show a variant embodiment of the electron tube of FIGS. 6*a* and 6*b* comprising an adjusting device for adjusting, according to the invention, the position of the electron gun of the tube.

In this variant of FIGS. 7*a* and 7*b* a gun 182 comprises a circular envelope 184 of ceramic material having on its axis Zc,Zc' the anode-wehnelt assembly 86 of FIGS. 6*a* and 6*b*. A circular edge 188 of the circular envelope of the gun 182, on the side of an anode wall 190 of the tube, comprises a ring-shaped swivel collar 194 having a lower part 196 and an upper part 198. The lower part 196 of the swivel collar comprises a partially spherical concave circular surface inscribed within the sphere 138 of radius R centred on the centre O of the cathode.

The anode wall 190 is prolonged towards the gun in the form of an anode ring 200 of thickness Ec close to the thickness of the circular envelope 184 of the gun, with axis Zs,Zs' and with external surface inscribed within the same circle of radius R centred on the centre O of the cathode so as to form with the partially spherical concave circular surface of the swivel collar 194 a swivel 210 for angular adjustment of the gun.

In this variant, the swivel collar 194 surrounding the gun is secured directly to the circular envelope 184 of the gun in a plane T' perpendicular to the axis Zc,Zc' of the gun.

The anode wall 190 of the tube is secured to the gun 182 by a deformable circular bellows 212 surrounding the gun, one of the circular ends of the bellows being secured to the swivel collar 194, the other circular end being secured to the anode wall 190 of the tube.

The upper part 198 of the swivel collar surrounding the gun comprises four adjusting screws 160 (at least three screws in the general case) for adjusting the angular position of the gun, with axes parallel to the axis of the gun, and distributed regularly over the swivel collar 194 around the gun, the ends of the adjusting screws being in contact with the anode wall 190 so as to exert forces on the said anode wall and to rotate the gun 182 around the centre O of the cathode in such a way as to establish, as in the case of the embodiment of FIGS. 6*a* and 6*b*, the alignment of the axis Zc,Zc' of the gun with the axis Zs,Zs' of the circular cylindrical passage 66 in the microwave structure.

The electron tubes according to the invention make it possible to correct, by virtue of the adjusting swivels between the gun and the microwave structure of the tube, the parallelism defects which arise when mounting the tube without introducing concentricity defects.

The invention claimed is:

1. An electron tube comprising:

a microwave structure, an electron gun having a cathode-wehnelt assembly, with axis Zc,Zc' for providing a linear electron beam along the same axis Zc,Zc' in a circular cylindrical passage with axis Zs,Zs' of the microwave structure, the cathode comprising a centre O of rotation of the beam on said axis Zc,Zc' of the cathode, wherein the electron gun and the microwave structure each comprise portions of spherical surfaces in contact inscribed on one and the same sphere of radius R centred on the centre O of the cathode so as to form a swivel for angular adjustment of the axis Zc,Z' of the cathode and to make the axis Zc,Zc' of the electron beam coincide with the axis Zs,Zs' of the said circular cylindrical passage of the microwave structure.

2. The electron tube according to claim 1, wherein the gun further comprises a ceramic circular envelope with axis of revolution Zc,Zc' having two ends, one of the ends being on the microwave structure side and, inside the circular envelope, on the axis Zc,Zc', the cathode-wehnelt assembly of the gun.

3. The electron tube according to claim 2, wherein the end of the circular envelope in proximity to the microwave structure is prolonged by a tubular wall, coaxial with the axis of the circular envelope of the gun and secured to the said end of the circular envelope, the tubular wall comprising, on the side of its free end, a setup ring having an external circular surface inscribed within the sphere of radius R centred on the centre O of the cathode, the microwave structure having, on the side of the setup ring, an anode wall, in a plane T perpendicular to the axis Zs,Zs', secured to the microwave structure, the anode wall comprising a circular recess with axis Zs,Zs' of partially spherical shape inscribed within the same sphere of radius R centred on the centre O of the cathode so as to form with the setup ring of the gun the swivel for adjusting the angular position θ of the gun, a hole in the anode wall, with axis Zs,Zs', for the passage of the electron beam into the microwave structure.

4. The electron tube according to claim 3, wherein the gun comprises, furthermore, a device for adjusting its angular position θ having, on the side of the setup ring, an adjusting collar surrounding the circular envelope of the gun and secured mechanically to the said circular envelope in a plane T' perpendicular to the axis Zc,Zc' of the gun by way of a ring-shaped bush surrounding the gun, the adjusting collar comprising threaded holes for at least three adjusting screws for adjusting the angular position of the gun, with axes parallel to the axis of the gun, and distributed regularly over the adjusting collar around the gun, the ends of the adjusting screws being in contact with the anode wall so as to exert forces on the said anode wall and to rotate the gun about the centre O of the cathode so as to establish the alignment of the axis Zc,Zc' of the gun with the axis Zs,Zs' of the circular cylindrical passage in the microwave structure.

5. The electron tube according to claim 4, wherein the anode wall is secured to the gun by a deformable circular bellows surrounding the gun, one of the circular ends of the bellows being secured to the adjusting collar surrounding the gun, the other circular end of the said bellows being secured to the anode wall of the microwave structure.

6. The electron tube according to claim 3, wherein the anode wall is secured to the gun by a deformable circular bellows surrounding the gun, one of the circular ends of the bellows being secured to the adjusting collar surrounding the gun, the other circular end of the said bellows being secured to the anode wall of the microwave structure.

7. The electron tube according to claim 6, wherein the bellows is made of a material such as a nickel alloy, stainless steel, or any other material sufficiently resistant to the loads from the atmospheric pressure but also deformable.

8. The electron tube according to claim 2, wherein the gun further comprises a circular envelope of ceramic material having on its axis Zc,Zc' the cathode-wehnelt assembly, an edge of the circular envelope of the gun, on the side of an anode wall of the microwave structure, comprises a ring-shaped swivel collar having an upper part and a lower part, the lower part of the swivel collar comprises a partially spherical concave circular surface inscribed within the sphere of radius R centred on the centre O of the cathode, the anode wall being prolonged towards the gun in the form of an anode ring of thickness Ec close to the thickness of the circular envelope of the gun, with axis Zs,Zs' and with external surface inscribed within the same circle of radius R centred on the centre of rotation O of the cathode so as to form with the partially spherical concave circular surface of the swivel collar a swivel for angular adjustment of the gun.

9. The electron tube according to claim 8, wherein the upper part of the swivel collar surrounding the gun comprises at least three adjusting screws for adjusting the angular position of the gun, with axes parallel to the axis of the gun, and distributed regularly over the swivel collar around the gun, the ends of the adjusting screws being in contact with the anode wall so as to exert forces on the said anode wall and to rotate the gun about the centre O of the cathode so as to establish the alignment of the axis Zc,Zc' of the gun with the axis Zs,Zs' of the circular cylindrical passage in the microwave structure.

* * * * *